US005947839A

United States Patent [19]

Kusumoto

[11] Patent Number: 5,947,839

[45] **Date of Patent: *Sep. 7, 1999**

[54] GOLF CLUB SHAFT

[75] Inventor: Harunobu Kusumoto, Saitama, Japan

[73] Assignee: Daiwa Seiko, Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/792,730

[22] Filed: Jan. 31, 1997

[30] Foreign Application Priority Data

Jan. 31, 1996 [JP] Japan ..... 8-016014

[51] Int. Cl.[6] ..... A63B 53/10

[52] U.S. Cl. ..... 473/319; 273/DIG. 23

[58] Field of Search ..... 473/318, 319, 473/320, 321; 273/DIG. 7, DIG. 23

[56] References Cited

U.S. PATENT DOCUMENTS

| | | | |
|---|---|---|---|
| 3,998,458 | 12/1976 | Inoue | 473/319 |
| 4,000,896 | 1/1977 | Lauraitis | 273/DIG. 23 |
| 5,018,735 | 5/1991 | Meredith | 473/318 |
| 5,265,872 | 11/1993 | Tennent | 473/320 |
| 5,569,098 | 10/1996 | Klein | 473/300 |
| 5,575,473 | 11/1996 | Turner | 473/298 |
| 5,607,364 | 3/1997 | Hedrick | 473/318 |

FOREIGN PATENT DOCUMENTS

| | | |
|---|---|---|
| 55-131275 | 9/1980 | Japan . |
| 5-337223 | 12/1993 | Japan . |
| 7-124277 | 5/1995 | Japan . |
| 8-89605 | 4/1996 | Japan . |

*Primary Examiner*—Jeanette Chapman
*Assistant Examiner*—Stephen L. Blau
*Attorney, Agent, or Firm*—Liniak, Berenato, Longacre & White

[57] ABSTRACT

A golf club shaft which can enhance the directivity of a golf ball. In the golf club shaft, the kick point and the position at which the torsional rigidity in the circumferential direction is lowest are set at a position distant from the front end portion of the shaft by 30 to 50% with respect to the overall length of the shaft and made to coincide substantially with each other.

6 Claims, 5 Drawing Sheets

GOLF CLUB SHAFT

BACKGROUND OF THE INVENTION

The present invention relates to a golf club shaft in which the directivity of a golf ball that has been hit by the golf club can be enhanced.

In order to increase the rigidity of the base end side of a golf club shaft at which a grip is attached, the golf club shaft is formed into a tapered shape in which the diameter of the golf club shaft is gradually increased at it comes from the front end to the base end.

Usually, a kick point is set at a position distant from the front end of the shaft by 30 to 50% with respect to the overall length of the shaft. When the kick point is set at a position in the above range, a golf ball is not raised too high or too low after it has been hit by the golf club, so that the golf ball can fly along a desired trajectory.

In this connection, the golf club is constructed in such a manner that a heavy head is attached to the front end of a shaft, and further the center of gravity of the head is made to deviate toward the back side of the head with respect to the axial direction of the shaft. As a result of the above construction, when a golfer swings down the golf club, the head is twisted in the circumferential direction of the shaft at a position where the torsional rigidity of the shaft is lowest. A direction of torsion of the head is different from a direction of deflection of the shaft at the kick point. Accordingly, at the moment of the impact of the head against a golf ball, an advancing direction of the head does not coincide with a direction of the face of the head. Accordingly, even if the golf ball is hit at a sweet spot on the face of the head, it is impossible for the golf ball to be shot in the target direction.

As shown by a broken line in the graph of FIG. 2, in the conventional shaft of this type, the torsional rigidity of a small diameter portion of the front end of the shaft, that is, the torsional rigidity of the end portion of the shaft at which the head is fixed is lowest. However, the present applicant has discovered that the directivity of a golf ball, which has been hit by a golf club, can be enhanced when a position of the shaft at which the torsional rigidity is lowest is located at a position close to the kick point or nearer to the base end side of the golf club shaft than the kick point.

In this connection, Japanese Unexamined Utility Model Publication No. 55-1311275 discloses a shaft 9 illustrated in FIG. 9, the detail of which will be described as follows. A sheet 1 impregnated with synthetic resin, on which carbon fibers are arranged in one direction, is wound and formed into a shaft body 3. On the front end side and the base end side of the shaft body 3, kick point adjusting sheets 5, 7 formed from sheets, on which carbon fibers are arranged in the direction of angle 0 ] with respect to the axis of the shaft body 3, are respectively wound round the shaft body 3, and an interval of the two kick point adjusting sheets 5, 7 are arbitrarily adjusted, so that the kick point position can be adjusted.

When an amount of high strength fibers such as carbon fibers arranged in the direction of angle 0 ] with respect to the axis of the shaft 9 is changed, it is possible to adjust the position of the kick point. However, even if the amount of high strength fibers arranged in the direction of angle 0 ] with respect to the axis of the shaft 9 is changed, it is impossible to adjust a position where the torsional rigidity is low.

That is, in order to adjust the torsional rigidity of a shaft, it is necessary to change an amount of high strength fibers which are arranged on the circumferential direction of the shaft.

When a small diameter portion 11 is formed on the shaft 9 as illustrated in FIG. 9, the golf club looks unattractive, and further there is a possibility that the shaft 9 is damaged at the small diameter portion 11 in the case of stress concentration.

SUMMARY OF THE INVENTION

The present invention has been accomplished in view of the above circumstances. An object of the present invention is to provide an attractive golf club shaft by which the directivity of a golf ball, which has been hit by the golf club, can be enhanced, and there is no possibility of damage of the golf club shaft.

In order to accomplish the above object, a golf club shaft according to the present invention is characterized in that: a kick point and a position at which the torsional rigidity in the circumferential direction of the golf club shaft is lowest are made to coincide substantially with each other, or the position at which the torsional rigidity in the circumferential direction of the golf club shaft is lowest is located nearer to the base end side of the golf club shaft than the kick point is.

As a further characterizing feature of the present invention, both the kick point and the lowest torsional rigidity position or at least the kick point are set at positions distant from a front end of the golf club shaft by 30 to 50% with respect to the overall length of the golf club shaft. As a further characterizing feature of the present invention, the golf club shaft is made of fiber-reinforced resin, and an amount of fibers provided in the circumferential direction at a position at which the torsional rigidity is lowest is smaller than the amounts of fibers provided on the front end side and the base end side of the golf club shaft. As a further characterizing feature of the present invention, the golf club shaft is formed into a tapered shape in which the diameter is gradually reduced as it comes from the base end to the front end of the golf club shaft.

Since the kick point is set at a position distant from the front end portion by 30 to 50% with respect to the overall length of the shaft, when a golf ball is hit by the golf club, the golf ball is not raised too high or too low after it has been hit by the golf club, so that the golf ball can fly along a desired trajectory.

A heavy head is attached to the front end of a shaft, and further the center of gravity of the head is made to deviate toward the back side of the head with respect to the axial direction of the shaft. As a result of the above construction, when a golfer swings down the golf club, the head is twisted in the circumferential direction of the shaft at a position where the torsional rigidity of the shaft is lowest. However, the position where the torsional rigidity on the circumferential direction is lowest coincides with the kick point, or the position where the torsional rigidity on the circumferential direction is nearer to the base end side of the gold club shaft than the kick point. Accordingly, a restoring force of the torsion of the head substantially synchronizes with a restoring force of the deflection of the shaft, or the amount of the torsion and the timing of restoring of the torsion can be readily sensed by the golfer. Therefore, at the moment of the impact of the head against a golf ball, an advancing direction of the head can be made substantially to substantially coincide with a direction of the face of the head.

Since the shaft is formed into a tapered shape, the outer diameter of the shaft is the same as that of the conventional shaft. Therefore, the mechanical strength of the shaft at the position where the torsional rigidity is lowest can be maintained.

DETAILED DESCRIPTION OF THE PREFERRED EMBODIMENTS

Referring to the accompanying drawings, embodiments of the present invention will be explained as follows.

Figure 1:
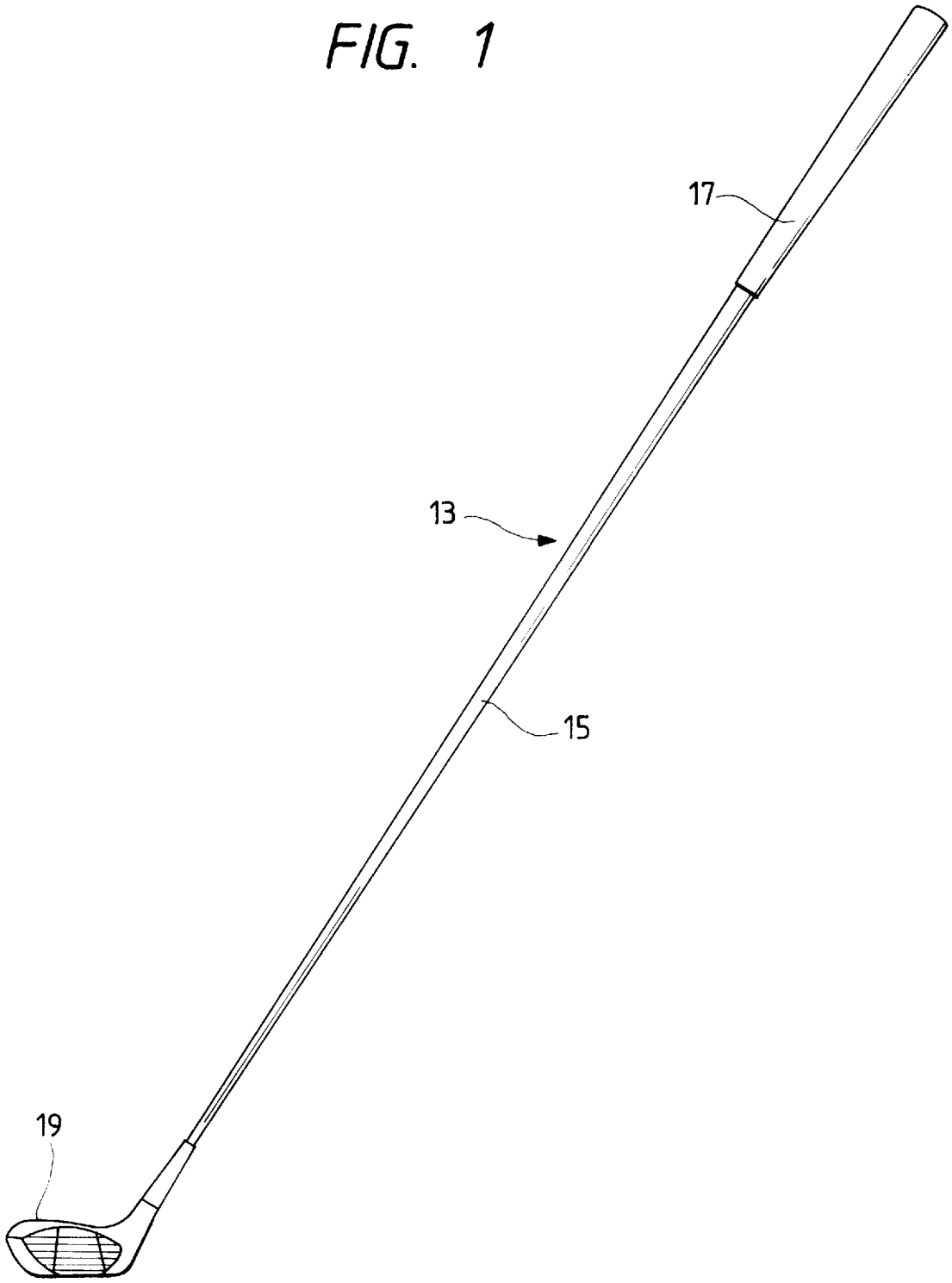
FIG. 1 is a front view of the golf club in which the shaft of the first embodiment according to the present invention.

FIGS. 1 to 4 are views showing the first embodiment of the shaft according to the present invention. In FIG. 1, reference numeral 13 is a golf club in which a shaft 15 of the present invention made of fiber-reinforced resin is used. In the same manner as that of a conventional golf club, the shaft 15 is formed into a tapered shape in which the diameter is gradually reduced as it comes from a base end portion at which a grip 17 is attached, to a front end portion at which a head 19 is attached.

Figure 2:
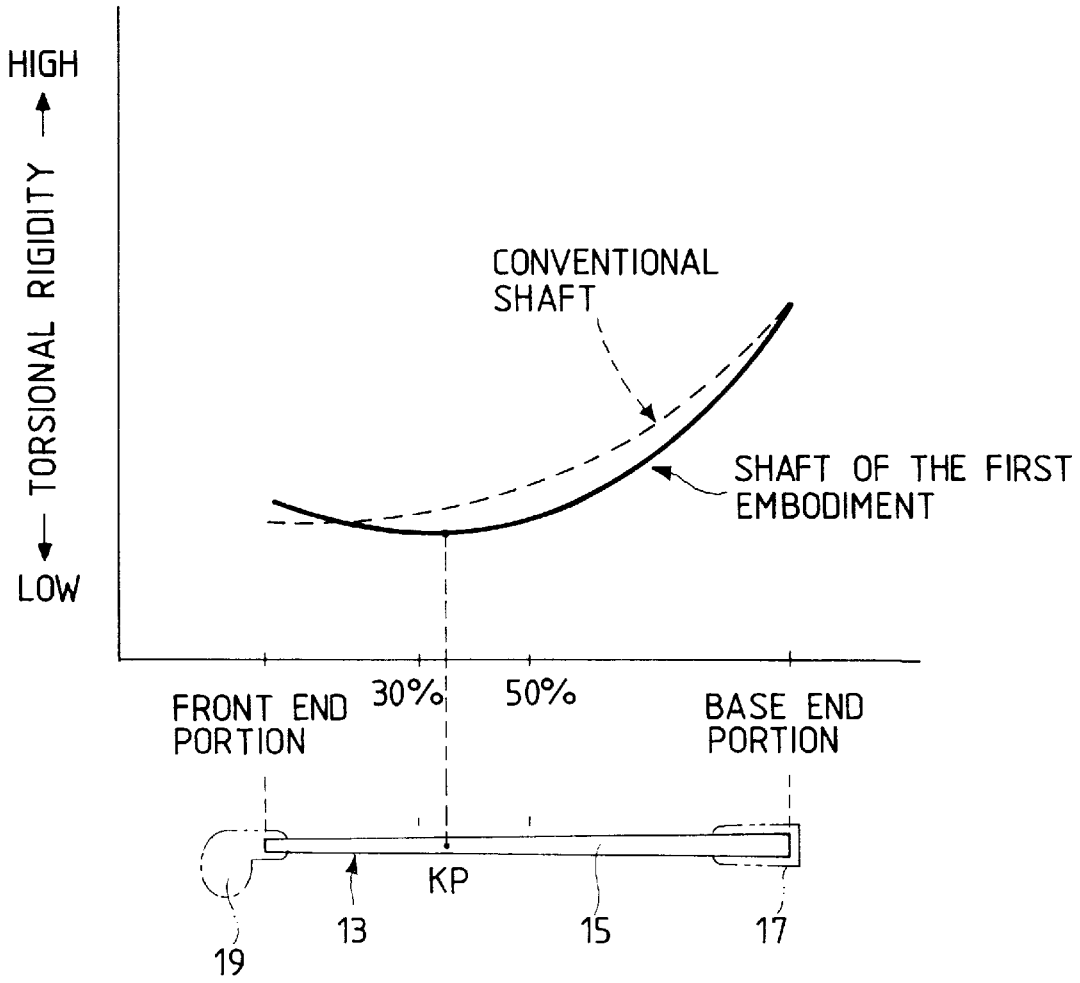
FIG. 2 is a schematic illustration showing a positional relation between the kick point and the position at which the torsional rigidity is lowest, wherein this positional relation is shown with respect to the shaft of the first embodiment and the shaft of the conventional example.

As illustrated in FIG. 2, the kick point KP is set at a position distant from the front end portion by about 35% with respect to the overall length of this shaft 15. In addition to that, this embodiment is characterized in that a position at which the torsional rigidity of the shaft in the circumferential direction is lowest is made to coincide substantially with the kick point KP.

Figure 3:
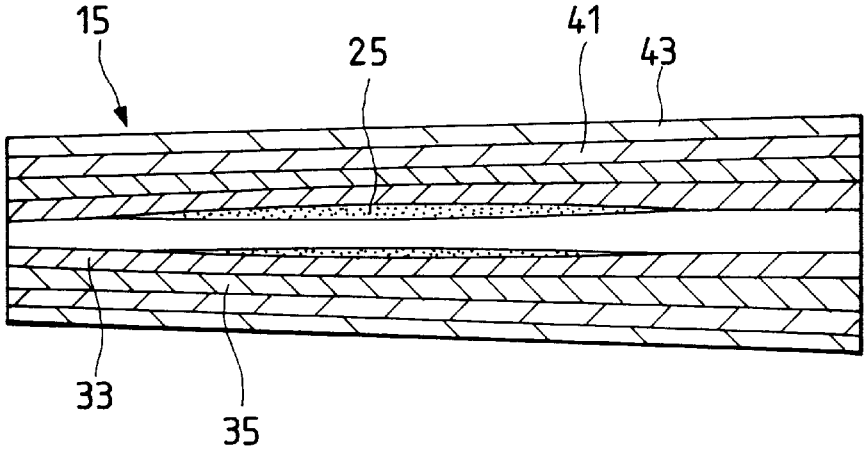
FIG. 3 is a cross-sectional view of the shaft according to the first embodiment.
Figure 4:
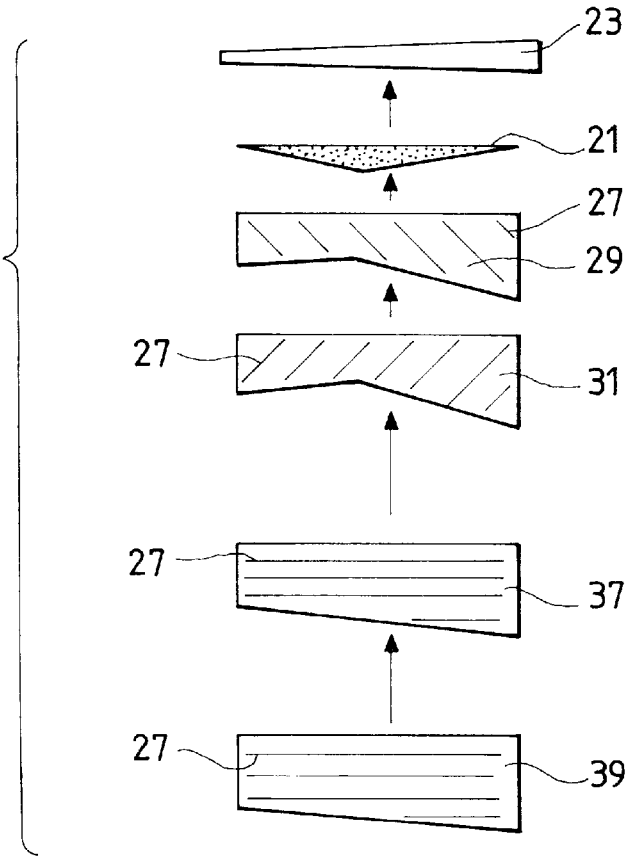
FIG. 4 is a process drawing of the manufacturing method of the shaft shown in FIG. 3.

As illustrated in FIG. 3, the above shaft 15 includes: a resin layer 25 formed when a prepreg sheet 21 made of thermosetting resin, for example epoxy resin, is wound round a mandrel 23 by a plurality of times as illustrated in FIG. 4; angle layers 33, 35 formed when prepreg sheets 29, 31 are wound by a plurality of times, on which carbon fibers 27, the diameters of which are 7 to 8 $\mu$m, are arranged in the direction the upper left by an angle of 45 ⌋ and also in the direction of the upper right by an angle of 45 ⌋, wherein the carbon fibers are impregnated with thermosetting synthetic resin; and straight layers 41, 43 formed when prepreg sheets 37, 39 are wound by a plurality of times, on which carbon fibers 27 are arranged in the axial direction of the shaft 15, wherein the carbon fibers are impregnated with thermosetting synthetic resin.

In order to make a position, at which the torsional rigidity of the shaft in the circumferential direction is lowest, coincide substantially with the kick point KP, as illustrated in FIG. 4, the prepreg sheets 29, 31 are greatly cut out inward at positions distant from the front end portion of the shaft by 35% with respect to the overall length. When the above prepreg sheets 29, 31 are wound, an amount of fibers in a portion of the shaft distant from the front end portion by 35% with respect to the overall length of the shaft can be reduced as compared with the amounts of fibers in the front end portion and the base end portion.

When these prepreg sheets 29, 31 are wound which are greatly cut out inward, the shaft looks unattractive because the diameter of the shaft at the position where the torsional rigidity is lowest becomes small.

In order to improve the looks of the shaft, as illustrated in FIG. 4, the prepreg sheet 21 is formed into a triangle, the vertex of which is located at a position where the prepreg sheets 29, 31 are cut out inward most greatly. As illustrated in FIG. 3, the thickness of the resin layer 25 formed by the prepreg sheet 21 described above is largest at a position distant from the front end portion of the shaft 15 by 35% with respect to the overall length. Therefore, an outline of the shaft 15 is formed into a gradually tapered shape.

In this connection, in the same manner as that of a conventional shaft, each prepreg sheet 37, 39 is formed into a trapezoid, the width of which is gradually increased as it comes from the front end portion to the base end portion of the shaft 15. In general, when the prepreg sheet formed into a trapezoidal shape as described above is wound by a plurality of times, the kick point can be set in a range from 30 to 50% of the overall length of the shaft.

Accordingly, in this embodiment, each prepreg sheet 37, 39 is formed into a predetermined trapezoidal shape so that the kick point KP can be located at a position distant from the front end portion of the shaft 15.

Since the shaft 15 of this embodiment is formed in the above manner, the kick point is set at the position distant from the front end portion by 35% with respect to the overall length. Therefore, when a golf ball is hit by the golf club 13 into which the above shaft 15 is incorporated, the golf ball is not raised too high or too low after it has been hit by the golf club, so that the golf ball can fly along a desired trajectory.

The golf club 13 is formed in such a manner that a heavy head 19 is attached to the front end of the shaft 15, and further the center of gravity of the head 19 is made to deviate toward the back side of the head with respect to the axial direction of the shaft 15. As a result of the above construction, when a golfer swings down the golf club 13, the head 19 is twisted in the circumferential direction of the shaft 15 at a position where the torsional rigidity of the shaft 15 is lowest. As described above, in this embodiment, the position where the torsional rigidity on the circumferential direction is lowest is made to coincide substantially with the kick point KP. Accordingly, a restoring force of the torsion of the head 19 substantially synchronizes with a restoring force of the deflection of the shaft 15. Therefore, at the moment of the impact of the head 19 against a golf ball, an advancing direction of the head 19 substantially coincides with a direction of the face of the head 19.

Consequently, according to this embodiment, it is possible for a golfer to hit a golf ball in the target direction, so that the golf ball can fly along a predetermined trajectory.

Figure 9:
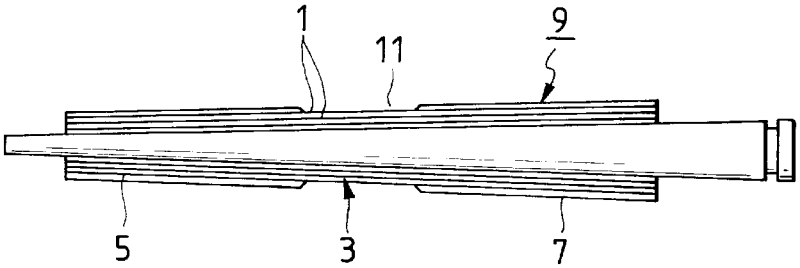
FIG. 9 is a cross-sectional view of the conventional shaft.

Further, as illustrated in FIG. 3, the position at which the torsional rigidity is lowest is not a small diameter portion in this embodiment, and this position is reinforced by the resin layer 25, which is arranged inside the angle layers 33, 35, so that an outline of the shaft 15 can be formed into a gradually tapered shape. Therefore, the looks of the shaft can be improved unlike the conventional example illustrated in FIG. 9. Since the occurrence of stress concentration can be avoided, there is no possibility that the shaft 15 is damaged at the position where the torsional rigidity is lowest.

Figure 5:
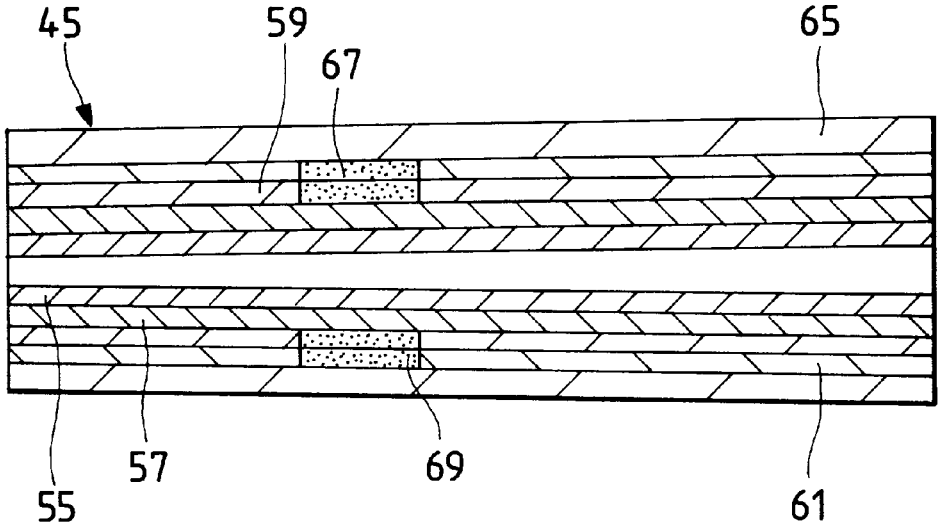
FIG. 5 is a cross-sectional view of the shaft according to the second embodiment of the present invention.
Figure 6:
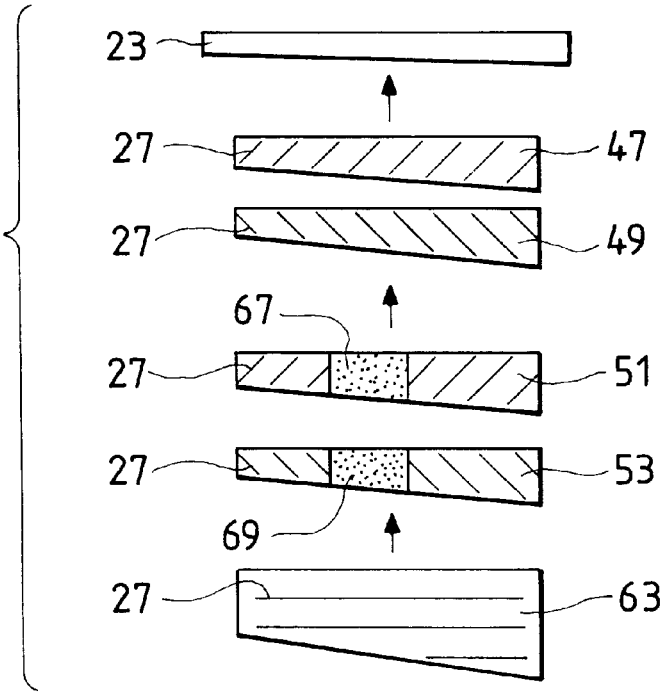
FIG. 6 is a process drawing of the manufacturing method of the shaft shown in FIG. 5.

FIGS. 5 and 6 are views showing a shaft of the second embodiment according to the present invention. In the same manner as that of the first embodiment, the shaft 45 of this embodiment is formed into a tapered shape in which the diameter of the shaft is gradually reduced as it comes from the front end portion to the base end portion, and the kick point is set at a position distant from the front end portion by 35% with respect to the overall length of the shaft, and further the position at which the torsional rigidity in the circumferential direction is lowest is made to coincide substantially with the kick point. However, in the manufacturing process of the shaft 45, prepreg sheets different from those of the first embodiment are used in this embodiment.

As illustrated in FIGS. 5 and 6, the above shaft 45 is formed as follows. There are provided prepreg sheets 47, 49, 51, 53 on which carbon fibers 27 are arranged in the directions of the upper right and the upper left by an angle of 45 ], wherein these prepreg sheets are impregnated with thermosetting synthetic resin. Also, there is provided a prepreg sheet 63 on which carbon fibers 27 are arranged in the axial direction of the shaft 45, wherein the prepreg sheet is impregnated with thermosetting synthetic resin. The shaft 45 includes: angle layers 55, 57, 59, 61 formed when the above prepreg sheets 47, 49, 51, 53 are wound round a mandrel 23 by a plurality of times; and a straight layer 65 formed when the above prepreg sheet 63 is wound by a plurality of times.

As illustrated in FIG. 6, each prepreg sheet 47, 49, 51, 53, 63 is formed into a trapezoidal shape, the width of which is gradually increased as it comes from the front end portion to the base end portion of the shaft 45. In order to make the position, at which the torsional rigidity in the circumferential direction is lowest, coincide substantially with the kick point, on the prepreg sheets 51, 53, resin portions 67, 69 made of only thermosetting synthetic resin not containing carbon fibers 27 are formed on the overall surface in a portion distant from the front end portion of the shaft 45 by 35% with respect to the overall length. When these prepreg sheets 51, 53 are wound, an amount of fibers in the portion distant from the front end portion by 35% with respect to the overall length of the shaft 45 can be made smaller than the amounts of fibers in the front end and the base end portion.

The prepreg sheets 47, 49, 51, 53, 63 are formed into predetermined trapezoidal shapes so that the kick point can be located at the position distant from the front end by 35% with respect to the overall length of the shaft 45.

Since the shaft 45 of this embodiment is formed in the above manner, the kick point is set at the position distant from the front end portion by 35% with respect to the overall length of the shaft 45. Therefore, when a golf ball is hit by the golf club into which the above shaft 45 is incorporated, the golf ball is not raised too high or too low after it has been hit by the golf club, so that the golf ball can fly along a desired trajectory.

Also, in this embodiment, the position where the torsional rigidity on the circumferential direction of the shaft is lowest is made to coincide substantially with the kick point. Accordingly, when a golfer swings down the golf club, a restoring force of the torsion of the head substantially synchronizes with a restoring force of the deflection of the shaft 45. Therefore, at the moment of the impact of the head against a golf ball, an advancing direction of the head substantially coincides with a direction of the face of the head.

Consequently, according to this embodiment, it is possible for a golfer to hit a golf ball in the target direction, so that the golf ball can fly along a predetermined trajectory.

Also, in this embodiment, an outline of the shaft 45 is formed into a gradually tapered shape. Therefore, the looks of the shaft can be improved unlike the conventional example of the shaft illustrated in FIG. 9. Since the occurrence of stress concentration can be avoided, there is no possibility that the shaft 15 is damaged at the position where the torsional rigidity is lowest.

Figure 7:
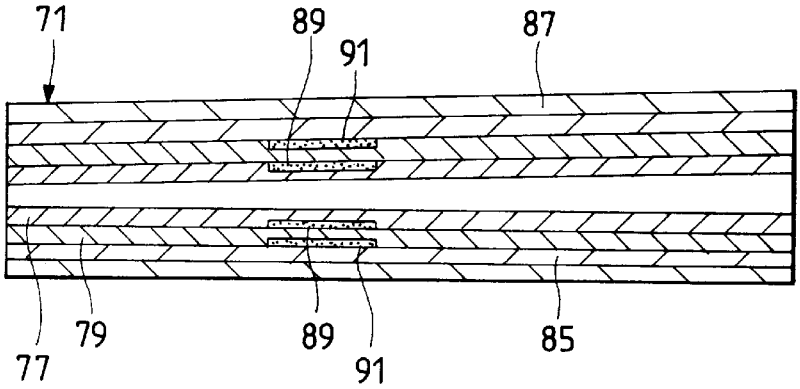
FIG. 7 is a cross-sectional view of the shaft according to the third embodiment of the present invention.
Figure 8:
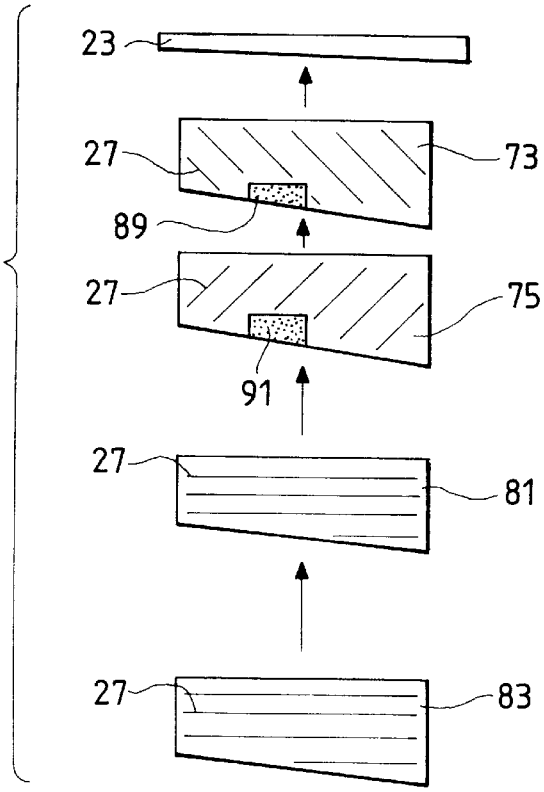
FIG. 8 is a process drawing of the manufacturing method of the shaft shown in FIG. 7.

FIGS. 7 and 8 are views showing the third embodiment of the shaft according to the present invention. In the manufacturing process of the shaft 71, prepreg sheets different from those of the first embodiment are used in this embodiment. The shaft 71 of this embodiment is formed into a tapered shape in which the diameter of the shaft is gradually reduced as it comes from the front end portion to the base end portion, and the kick point is set at a position distant from the front end portion by 35% with respect to the overall length of the shaft 71, and further the position at which the torsional rigidity in the circumferential direction is lowest is made to coincide substantially with the kick point.

As illustrated in FIG. 7, the above shaft 71 of this embodiment is formed as follows. As illustrated in FIG. 8, there are provided prepreg sheets 73, 75 on which carbon fibers 27 are arranged in the directions of the upper left and the upper right by an angle of 45 ], wherein these prepreg sheets are impregnated with thermosetting synthetic resin. Also, there are provided prepreg sheets 81, 83 on which carbon fibers 27 are arranged in the axial direction of the shaft 71, wherein the prepreg sheets are impregnated with thermosetting synthetic resin. The shaft 71 includes: angle layers 77, 79 formed when the above prepreg sheets 73, 75 are wound round a mandrel 23 by a plurality of times; and straight layers 85, 87 formed when the above prepreg sheets 81, 83 are wound by a plurality of times.

As illustrated in FIG. 8, each prepreg sheet 73, 75, 81, 83 is formed into a trapezoidal shape, the width of which is gradually increased as it comes from the front end portion to the base end portion of the shaft 71. In order to make the position, at which the torsional rigidity in the circumferential direction is lowest, coincide substantially with the kick point KP, resin portions 89, 91 made of only thermosetting synthetic resin not containing carbon fibers 27 are formed on one side in a portion distant from the front end portion of the shaft 71 by 35% with respect to the overall length. When these prepreg sheets 73, 75 are wound, an amount of fibers in the portion distant from the front end portion by 35% with respect to the overall length of the shaft 71 can be made smaller than the amounts of fibers in the front end and the base end portion.

The prepreg sheets 73, 75, 81, 83 are formed into predetermined trapezoidal shapes so that the kick point can be located at the position distant from the front end by 35% with respect to the overall length of the shaft 71.

Since the shaft 71 of this embodiment is formed in the above manner, when a golf ball is hit by the golf club into which the above shaft 71 is incorporated, the golf ball can be shot along a desired trajectory. Therefore, it is possible to accomplish the predetermined object.

In this connection, in each embodiment described above, the kick point is set at a position distant from the front end portion of the shaft by 35% with respect to the overall length, and a point at which the torsional rigidity in the circumferential direction is lowest is made to coincide substantially with the kick point. However, it should be noted that the kick point is not limited to the position distant from the front end portion of the shaft by 35%, but the kick point and the position at which the torsional rigidity in the circumferential direction is lowest may be located at any position in a range from 30 to 50% of the overall length of the shaft with respect to the front end portion. It is possible to accomplish the object of the invention by the aforementioned arrangement.

Further, in each embodiment, the position at which the torsional rigidity in the circumferential direction is lowest is located substantially coincident with the kick point. However, the present invention should not be restricted thereto or thereby. The position at which the torsional rigidity in the circumferential direction is lowest may be located nearer to the base end side of the shaft than the kick point. In this case, since the torsional rigidity in the circumferential direction is lowest is located closer to the golfer's hands gripping the golf club shaft than the kick point, the golfer can sense the amount of torsion and the timing of restoring of the torsion, and thus readily control the direction of the face of the golf club head. Consequently, the gold ball can be shot in the target direction without the slice shot and the hook shot.

As described above, according to the shaft of the invention, when a golfer swings down the golf club, a restoring force of the torsion of the head substantially synchronizes with a restoring force of the deflection of the shaft. Therefore, at the moment of the impact of the head against a golf ball, an advancing direction of the head substantially coincides with a direction of the face of the head. Accordingly, it is possible for the golfer to hit the golf ball along a trajectory in a predetermined direction. Therefore, the directivity of the golf ball that has been hit by the golf club of the present invention can be enhanced.

Also, an outline of the shaft is formed into a tapered shape. Therefore, the looks of the shaft can be improved unlike the conventional example in which a small diameter portion is formed. Since the stress concentration can be avoided, there is no possibility of damage of the shaft.

What is claimed is:

1. A golf club shaft, wherein a kick point and a position at which the torsional rigidity in the circumferential direction of the golf club shaft is lowest are set substantially coincident with each other in the axial direction of the golf club shaft at positions distant from a front end of the golf club shaft by 30 to 50% with respect to the overall axial length of the golf club shaft, and wherein the golf club shaft is made of fiber-reinforced resin, and an amount of fibers provided in the circumferential direction at a position at which the torsional rigidity is lowest is smaller than the amount of fibers provided on a front end side of the golf club shaft, the golf club shaft being formed into a tapered shape in which the diameter is gradually and continuously reduced as it comes from the base end to the front end.

2. The golf club shaft according to claim 1, wherein said fibers are oriented 45 degrees with respect to the axial direction and the golf club shaft is provided with a reduction of said 45 degree oriented fibers in the position at which the torsional rigidity is lowest.

3. A golf club shaft wherein a position at which the torsional rigidity in the circumferential direction of the golf club shaft is lowest is set closer to a base end side of the golf club shaft than a kick point in the axial direction of the golf club shaft, and wherein said golf club shaft is formed of at least one layered prepreg sheet, said sheet having an area of reduced fiber content located at a position at which the torsional rigidity is lowest.

4. A golf club shaft wherein a position at which the torsional rigidity in the circumferential direction of the golf club shaft is lowest is set closer to a base end side of the golf club shaft than a kick point in the axial direction of the golf club shaft, and wherein said golf club shaft is formed of at least one layered prepreg sheet, said sheet being formed to create a void along the axial direction of said golf club shaft when wound around a mandrel, said void being filled with a resin layer.

5. A golf club shaft according to claim 4, wherein said prepreg sheet comprises carbon fibers arranged at an angle with respect to the axial direction.

6. A golf club shaft, wherein a kick point and a position at which the torsional rigidity in the circumferential direction of the golf club shaft is lowest are set substantially coincident with each other in the axial direction of the golf club shaft at positions distant from a front end of the golf club shaft by 30 to 50% with respect to the overall axial length of the golf club shaft, and wherein the golf club shaft is made of fiber-reinforced resin, and an amount of fibers extending 45 degrees with respect to the axial at a position at which the torsional rigidity is lowest is smaller than the amount of fibers provided on a front end side of the golf club shaft, the golf club shaft being formed into a tapered shape in which the diameter is gradually and continuously reduced as it comes from the base end to the front end.

* * * * *